US011528559B2

(12) United States Patent
Huang et al.

(10) Patent No.: US 11,528,559 B2
(45) Date of Patent: Dec. 13, 2022

(54) DOUBLE SIDED SPEAKER DEVICE

(71) Applicant: LUXSHARE-ICT CO., LTD., Taipei (TW)

(72) Inventors: Jiin-Tarng Huang, Taipei (TW); Chih-Kai Sun, Taipei (TW)

(73) Assignee: LUXSHARE-ICT CO., LTD., Taipei (TW)

( * ) Notice: Subject to any disclaimer, the term of this patent is extended or adjusted under 35 U.S.C. 154(b) by 0 days.

(21) Appl. No.: 17/497,562

(22) Filed: Oct. 8, 2021

(65) Prior Publication Data

US 2022/0360903 A1 Nov. 10, 2022

(30) Foreign Application Priority Data

May 7, 2021 (CN) ..... 202110496508.5

(51) Int. Cl.
*H04R 9/02* (2006.01)
*H04R 7/00* (2006.01)
*H04R 9/06* (2006.01)

(52) U.S. Cl.
CPC ..... *H04R 9/025* (2013.01); *H04R 7/00* (2013.01); *H04R 9/06* (2013.01)

(58) Field of Classification Search
CPC ..... H04R 9/025; H04R 7/00; H04R 9/06
See application file for complete search history.

(56) References Cited

U.S. PATENT DOCUMENTS 3,393,764 A * 7/1968 Schafer ..... H04R 1/227 381/89
7,724,915 B2 * 5/2010 Matsumura ..... H04R 9/025 381/412
7,953,240 B2 * 5/2011 Matsumura ..... H04R 1/2803 381/337
8,755,558 B2 * 6/2014 Saiki ..... H04R 9/063 381/186

(Continued)

FOREIGN PATENT DOCUMENTS

CN 101180916 B 7/2011
CN 106792394 A 5/2017
CN 108632728 A 10/2018

(Continued)

*Primary Examiner* — Angelica M McKinney
(74) *Attorney, Agent, or Firm* — Birch, Stewart, Kolasch & Birch, LLP

(57) ABSTRACT

A double sided speaker device, comprising a magnetic conductive carrier board, a first magnetic circuit module, a second magnetic circuit module, a first voice coil, a second voice coil, a first sounding hood, and a second sounding hood. The magnetic conductive carrier board comprises a plurality of openings. The first magnetic circuit module is disposed at one side of the magnetic conductive carrier board. The second magnetic circuit module is disposed at the other side of the magnetic conductive carrier board. The first voice coil is disposed around the first magnetic circuit module. The second voice coil is disposed around the second magnetic circuit module. The first sounding hood is disposed at one side of the magnetic conductive carrier board and comprises a first accommodating space. The second sound- (Continued)

ing hood is disposed at the other side of the magnetic conductive carrier board and comprises a second accommodating space.

12 Claims, 6 Drawing Sheets

(56) References Cited

U.S. PATENT DOCUMENTS

| | | | | |
|---|---|---|---|---|
| 2011/0232990 | A1 | 9/2011 | Kobayashi et al. | |
| 2022/0150641 | A1* | 5/2022 | Ko | H04R 1/02 |

FOREIGN PATENT DOCUMENTS

| | | | | |
|---|---|---|---|---|
| CN | 208479943 | U | | 2/2019 |
| CN | 109511061 | A | | 3/2019 |
| CN | 109936803 | A | | 6/2019 |
| CN | 209642954 | U | | 11/2019 |
| CN | 111698621 | A | | 9/2020 |
| CN | 211531284 | U | | 9/2020 |
| CN | 211744719 | U | | 10/2020 |
| CN | 212034340 | U | * | 11/2020 |
| CN | 212324356 | U | | 1/2021 |
| CN | 112383853 | A | | 2/2021 |
| CN | 214507375 | U | | 10/2021 |
| CN | 114143675 | A | * | 3/2022 |
| KR | 10-2004-0014645 | A | | 2/2004 |
| TW | M610965 | U | | 4/2021 |
| TW | M615661 | U | | 8/2021 |

* cited by examiner

DOUBLE SIDED SPEAKER DEVICE

CROSS-REFERENCE TO RELATED APPLICATION

This application claims the priority benefit of Chinese Patent Application Serial Number 202110496508.5, filed on May 7, 2021, the full disclosure of which is incorporated herein by reference.

BACKGROUND

Technical Field

The present disclosure relates to the technical field of speaker, particularly to a double sided speaker device.

Related Art

Conventional double sided speaker devices normally comprise two voice coils and a magnetic circuit module shared by the two voice coils. The magnetic circuit module partitions the internal space of the double sided speaker device to into two resonance spaces, in which the two voice coils are respectively disposed. Since the two resonance spaces are not mutually communicated, poor tone quality of the sound of double sided speaker device is quite noticeable. To enhance the tone quality of the sound of the double sided speaker device by enlarging the resonance space would have the size of the double sided speaker device increased, which can be hardly fitting in thin electronic devices.

SUMMARY

The embodiments of the present disclosure provide a double sided speaker device tended to solve the problem of poor tone quality of the sound of conventional double sided speaker devices.

The present disclosure provides a double sided speaker device, comprising a magnetic conductive carrier board, a first magnetic circuit module, a second magnetic circuit module, a first voice coil, a second voice coil, a first sounding hood, and a second sounding hood. The magnetic conductive carrier board comprises a plurality of openings. The first magnetic circuit module is disposed at one side of the magnetic conductive carrier board. The second magnetic circuit module is disposed at the other side of the magnetic conductive carrier board. The second magnetic circuit module is opposite to the first magnetic circuit module. The plurality of openings is disposed between the first magnetic circuit module and the second magnetic circuit module. The first voice coil is disposed around the first magnetic circuit module. The second voice coil is disposed around the second magnetic circuit module. The second voice coil corresponds to the first voice coil. The first sounding hood is disposed at one side of the magnetic conductive carrier board and comprises a first accommodating space. The first magnetic circuit module and the first voice coil are disposed in the first accommodating space. The second sounding hood is disposed at the other side of the magnetic conductive carrier board and comprises a second accommodating space. The second magnetic circuit module and the second voice coil are disposed in the second accommodating space. The second accommodating space is communicating with the first accommodating space through the plurality of openings.

In the embodiments of the present disclosure, in the double sided speaker device, the magnetic conductive carrier board, the first voice coil, the first magnetic circuit module, and the first sounding hood form a first speaker part, and the magnetic conductive carrier board, the second voice coil, the second magnetic circuit module, and the second sounding hood form a second speaker part. The first voice coil works on the first magnetic circuit module and the second voice coil works on the second magnetic circuit module for realizing double side speaking. The first accommodating space and the second accommodating space play as the two resonant cavities for the double sided speaker device. The two resonant cavities are mutually connected through a plurality of openings. Thus, the capacity of the resonant cavity of the double sided speaker device can be increased, and the tone quality of the double sided speaker device can be effectively improved without increasing the size of the double sided speaker device.

It should be understood, however, that this summary may not contain all aspects and embodiments of the present disclosure, that this summary is not meant to be limiting or restrictive in any manner, and that the disclosure as disclosed herein will be understood by one of ordinary skill in the art to encompass obvious improvements and modifications thereto.

BRIEF DESCRIPTION OF THE DRAWINGS

The features of the exemplary embodiments believed to be novel and the elements and/or the steps characteristic of the exemplary embodiments are set forth with particularity in the appended claims. The Figures are for illustration purposes only and are not drawn to scale. The exemplary embodiments, both as to organization and method of operation, may best be understood by reference to the detailed description which follows taken in conjunction with the accompanying drawings in which:

DETAILED DESCRIPTION OF THE EMBODIMENTS

The present disclosure will now be described more fully hereinafter with reference to the accompanying drawings, in which exemplary embodiments of the disclosure are shown. This present disclosure may, however, be embodied in many different forms and should not be construed as limited to the embodiments set forth herein. Rather, these embodiments are provided so that this present disclosure will be thorough and complete, and will fully convey the scope of the present disclosure to those skilled in the art.

Certain terms are used throughout the description and following claims to refer to particular components. As one skilled in the art will appreciate, manufacturers may refer to a component by different names. This document does not intend to distinguish between components that differ in name but function. In the following description and in the claims, the terms "include/including" and "comprise/comprising" are used in an open-ended fashion, and thus should be interpreted as "including but not limited to". "Substantial/ substantially" means, within an acceptable error range, the person skilled in the art may solve the technical problem in a certain error range to achieve the basic technical effect.

The following description is of the best-contemplated mode of carrying out the disclosure. This description is made for the purpose of illustration of the general principles of the disclosure and should not be taken in a limiting sense. The scope of the disclosure is best determined by reference to the appended claims.

Moreover, the terms "include", "contain", and any variation thereof are intended to cover a non-exclusive inclusion. Therefore, a process, method, object, or device that includes a series of elements not only includes these elements, but also includes other elements not specified expressly, or may include inherent elements of the process, method, object, or device. If no more limitations are made, an element limited by "include a/an . . . " does not exclude other same elements existing in the process, the method, the article, or the device which includes the element.

Figure 1:
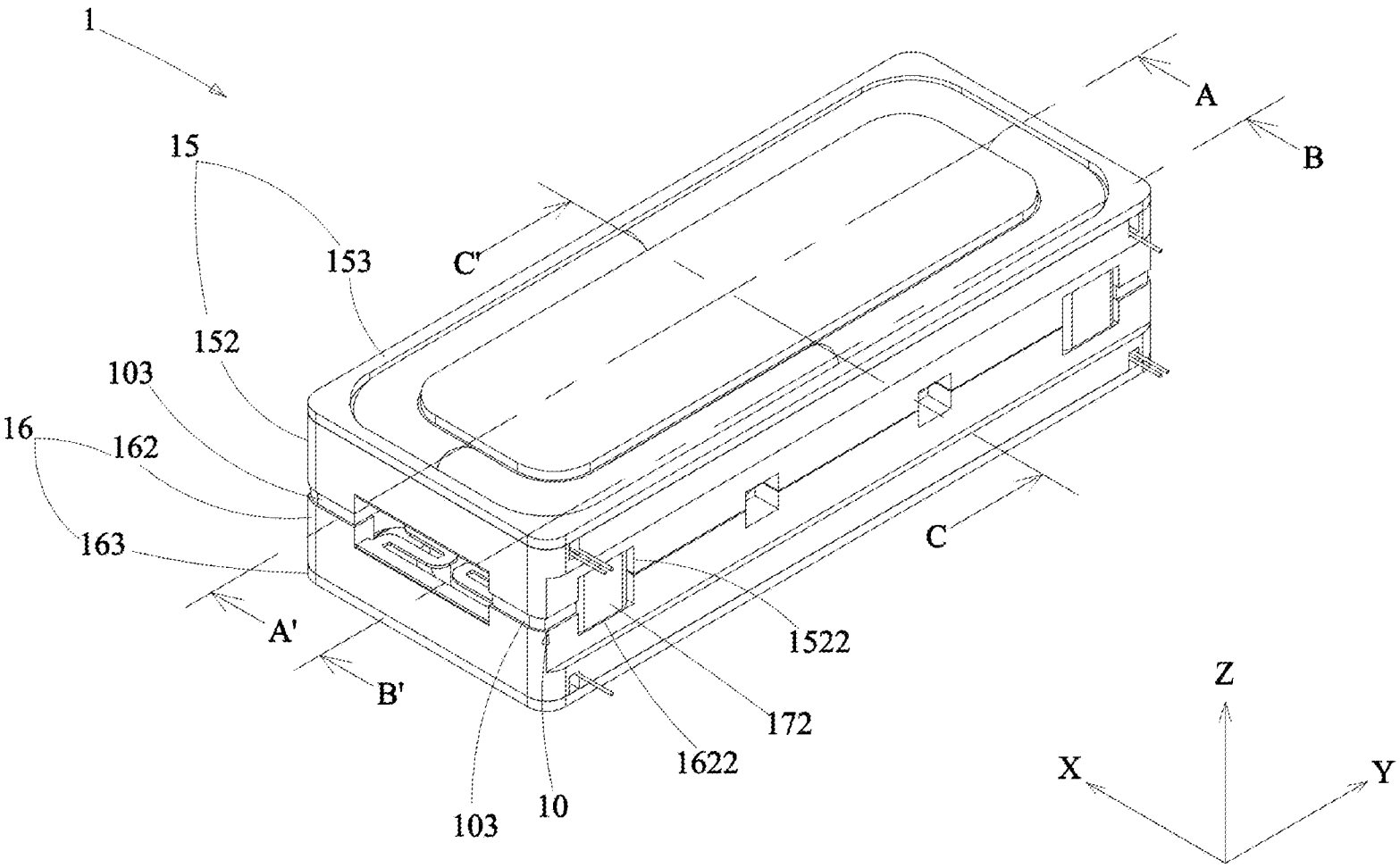
FIG. 1 is a perspective view of a double sided speaker device of an embodiment of the present disclosure.
Figure 2:
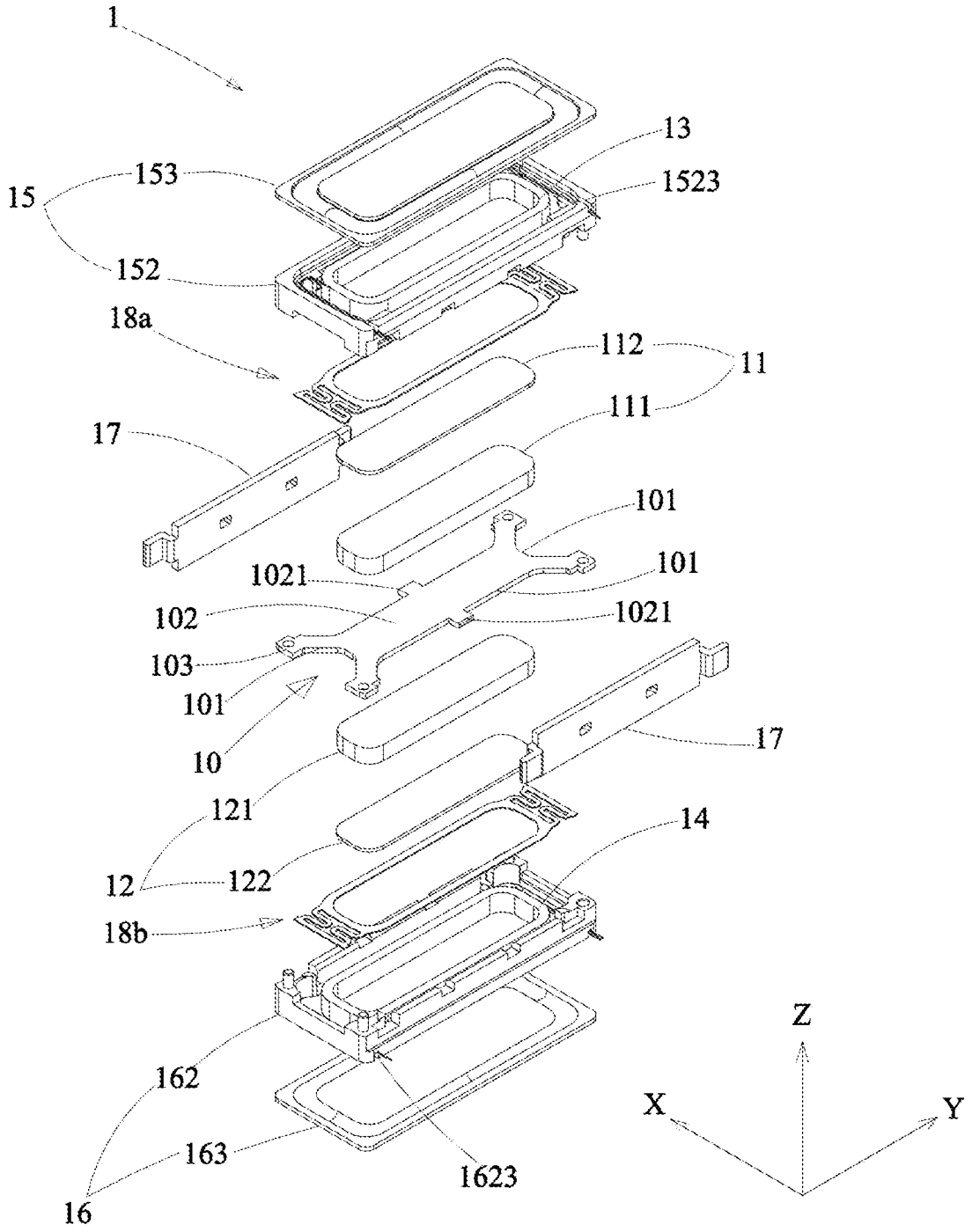
FIG. 2 is an exploded view of a double sided speaker device of an embodiment of the present disclosure.
Figure 3:
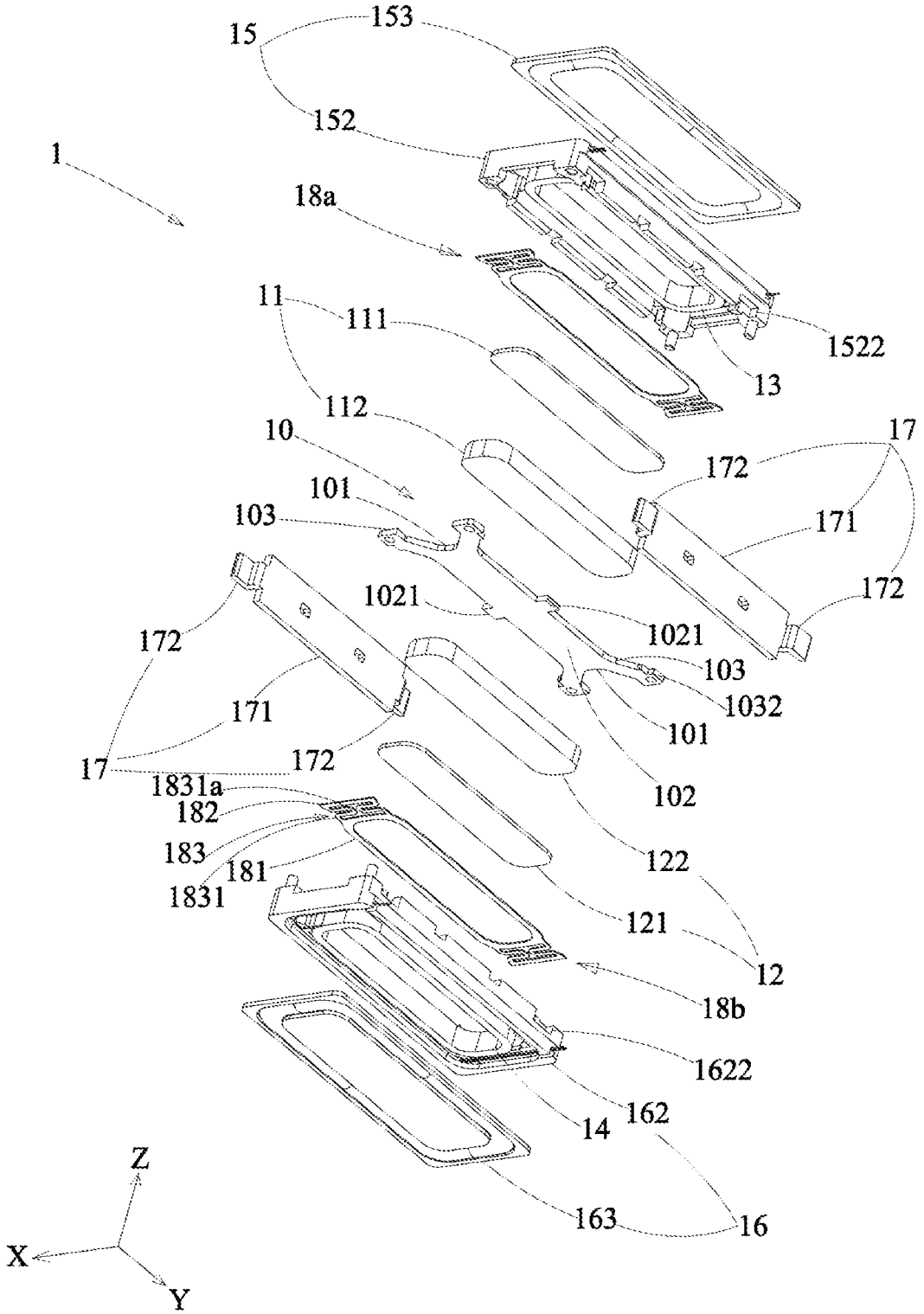
FIG. 3 is another exploded view of a double sided speaker device of an embodiment of the present disclosure.

FIG. 1 to FIG. 3 are perspective view and exploded views of a double sided speaker device of an embodiment of the present disclosure. As shown in the figures, in this embodiment, a double sided speaker device 1 comprises a magnetic conductive carrier board 10, a first magnetic circuit module 11, a second magnetic circuit module 12, a first voice coil 13, a second voice coil 14, a first sounding hood 15, and a second sounding hood 16. The magnetic conductive carrier board 10 comprises a plurality of openings 101 respectively arranged in a first direction X and a second direction Y. The first direction X is orthogonal to the second direction Y.

In this embodiment, the number of openings 101 is four. Two of the four openings 101 are arranged in the first direction X and are respectively disposed at the front side and the rear side of the magnetic conductive carrier board 10. The other two openings 101 are arranged in the second direction Y and are respectively disposed on the left side and right side of the magnetic conductive carrier board 10. The first magnetic circuit module 11 is disposed at one side of the magnetic conductive carrier board 10, and the second magnetic circuit module 12 is disposed at the other side of the magnetic conductive carrier board 10. In this embodiment, the first magnetic circuit module 11 and the second magnetic circuit module 12 are disposed at two opposite sides of the magnetic conductive carrier board 10 in a third direction Z orthogonal to the first direction X and the second direction Y. The first magnetic circuit module 11 is disposed at the upper side of the magnetic conductive carrier board 10, and the second magnetic circuit module 12 is disposed at the lower side of the magnetic conductive carrier board 10. The second magnetic circuit module 12 is opposite to the first magnetic circuit module 11.

Figure 4:
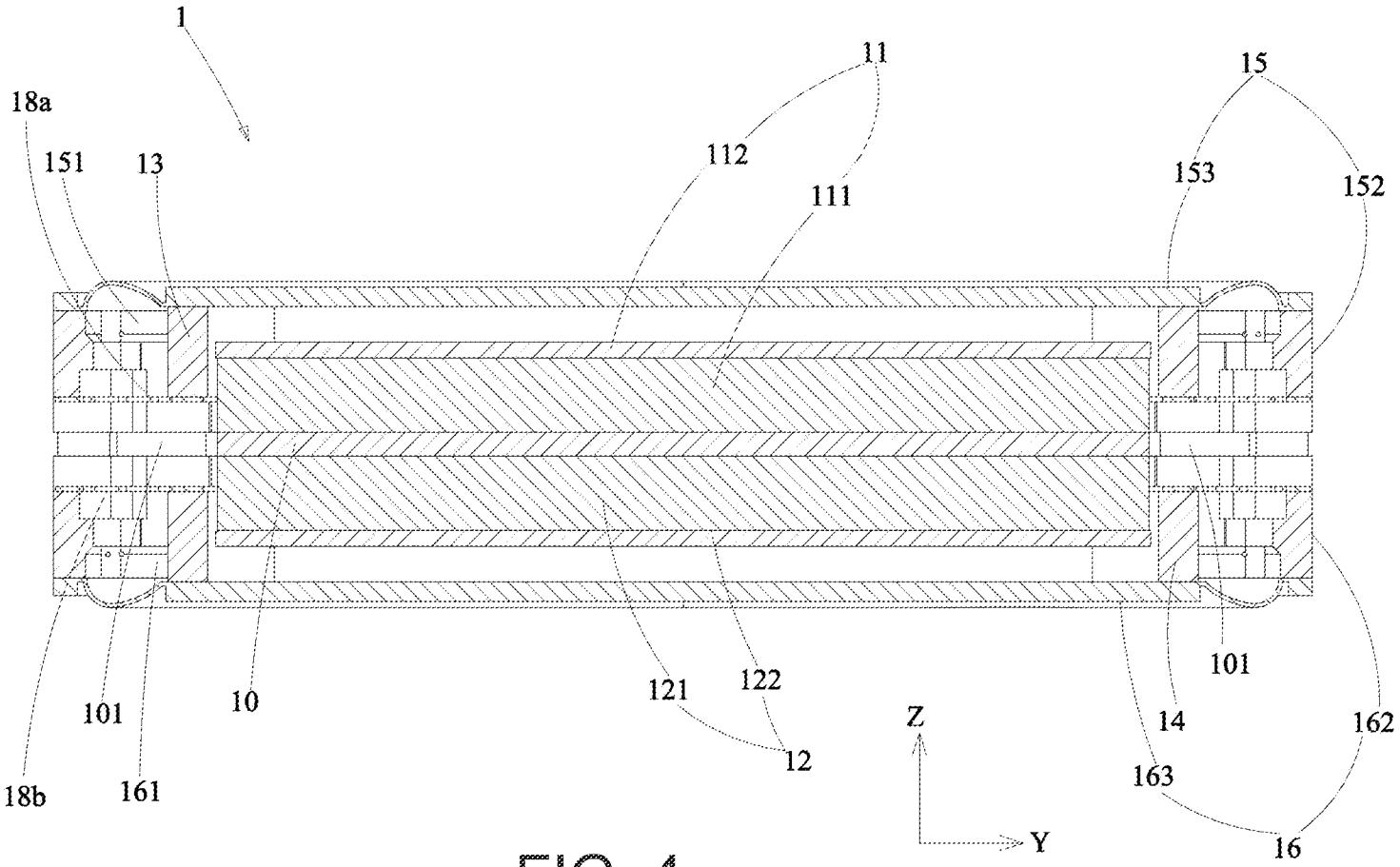
FIG. 4 is a cross-sectional view along line A-A' of FIG. 1.

As shown in FIG. 2 and FIG. 3, the plurality of openings 101 are disposed between the first magnetic circuit module 11 and the second magnetic circuit module 12. In this embodiment, the four openings 101 are disposed on the periphery of the first magnetic circuit module 11 and the periphery of the second magnetic circuit module 12. The first voice coil 13 is disposed around the first magnetic circuit module 11, and the second voice coil 14 is disposed around the second magnetic circuit module 12. The first voice coil 13 corresponds to the second voice coil 14. Referring to FIG. 4, the first sounding hood 15 is disposed at one side of the magnetic conductive carrier board 10 and comprises a first accommodating space 151, in which the first magnetic circuit module 11 and the first voice coil 13 are disposed. The second sounding hood 16 is disposed at the other side of the magnetic conductive carrier board 10 and comprises a second accommodating space 161, in which the second magnetic circuit module 12 and the second voice coil 14 are disposed. The second accommodating space 161 is in communication with the first accommodating space 151 through a plurality of openings 101.

In this embodiment, the first sounding hood 15 comprises a first bracket 152 and a first diaphragm 153. The first bracket 152 is disposed at one side of the magnetic conductive carrier board 10, and the first diaphragm 153 is disposed at one side of the first bracket 152 away from the magnetic conductive carrier board 10 and is connected with the first voice coil 13. Similarly, the second sounding hood 16 comprises a second bracket 162 and a second diaphragm 163. The second bracket 162 is disposed at the other side of the magnetic conductive carrier board 10, and the second diaphragm 163 is disposed at one side of the second bracket 162 away from the magnetic conductive carrier board 10 and is connected with the second voice coil 14.

As shown in FIG. 3 and FIG. 4, in this embodiment, when the double sided speaker device 1 is in operation, two ends of the first voice coil 13 and two ends of the second voice coil 14 would be connected to an external power source, the external power would supply electric current to the first voice coil 13 and the second voice coil 14, and the first voice coil 13 and the second voice coil 14 would generate a magnetic field. By adjusting the magnitude of the electric current supplied to the first voice coil 13 and the second voice coil 14, the magnitude and direction of the magnetic field generated by the first voice coil 13 and the second voice coil 14 can be correspondingly changed.

The magnetic field generated by the first voice coil 13 interacts with the magnetic field generated by the first magnetic circuit module 11 to cause the first voice coil 13 to vibrate in a direction orthogonal to the direction of the electric current, and the first voice coil 13 vibrates the first diaphragm 153 to sound. Similarly, the magnetic field generated by the second voice coil 14 interacts with the magnetic field generated by the second magnetic circuit module 12 to cause the second voice coil 14 to vibrate in a direction orthogonal to the direction of the electric current, and the second voice coil 14 vibrates the second diaphragm 163 to sound. In the double sided speaker device 1, a first speaker part is formed by the combination of the magnetic conductive carrier board 10, the first voice coil 13, the first magnetic circuit module 11, and the first sounding hood 15, and a second speaker part is formed by the combination of the magnetic conductive carrier board 10, the second voice coil 14, the second magnetic circuit module 12, and the second sounding hood 16 to realize double side sounding.

It should be further explained that since the mass vibration of the first voice coil 13 and that of the second voice coil 14 are the same to be mutually canceled, the vibration of the double sided speaker device 1 can be reduced and the vibration area of the first diaphragm 153 and the second diaphragm 163 can be increased to enhance the performance of the double sided speaker device 1. Besides, in this embodiment, the first accommodating space 151 and the second accommodating space 161 are respectively two resonant cavities of the double sided speaker device 1 that are mutually communicated through the plurality of openings 101. In this way, without increasing the size of the double sided speaker device 1, the capacity of the resonant cavity of the double sided speaker device 1 can be increased, and the stereo sounding of the double sided speaker device 1 can be enhanced.

As shown in FIG. 2 and FIG. 4, in this embodiment, a surface of the first bracket 152 connected with the first diaphragm 153 comprises a first wiring groove 1523 communicating with the first accommodating space 151. Similarly, a surface of the second bracket 162 connected with the second diaphragm 163 comprises a second wiring groove 1623 communicating with the second accommodating space 161. Two ends of the first voice coil 13 respectively pass through the first wiring grooves 1523 to the outside of the speaker device to be connected with an external power source. Similarly, two ends of the second voice coil 14 respectively pass through the second wiring grooves 1623 to the outside of the speaker device to be connected with an external power source.

FIG. 4 is a cross-sectional view along line A-A' of FIG. 1. As shown in the figure, in this embodiment, the first magnetic circuit module 11 comprises a first magnetic body 111 and a first magnetic conductive board 112. The first magnetic body 111 is disposed at one side of the magnetic conductive carrier board 10, and the first magnetic conductive board 112 is disposed at one side of the first magnetic body 111 away from the magnetic conductive carrier board 10. Similarly, the second magnetic circuit module 12 comprises a second magnetic body 121 and a second magnetic conductive board 122. The second magnetic body 121 is disposed at the other side of the magnetic conductive carrier board 10, and the second magnetic conductive board 122 is disposed at one side of the second magnetic body 121 away from the magnetic conductive carrier board 10. In this embodiment, the magnetic poles of the magnetic conductive carrier board 10 are different from that of the first magnetic body 111 and the second magnetic body 121, and the magnetic poles of the first magnetic conductive board 112 and the second magnetic conductive board 122 are different from that of the first magnetic body 111 and the second magnetic body 121. For example, the magnetic poles of the magnetic conductive carrier board 10, the first magnetic conductive board 112, and the second magnetic conductive board 122 are N poles, and the magnetic poles of the first magnetic body 111 and the second magnetic body 121 are S poles.

Figure 5:
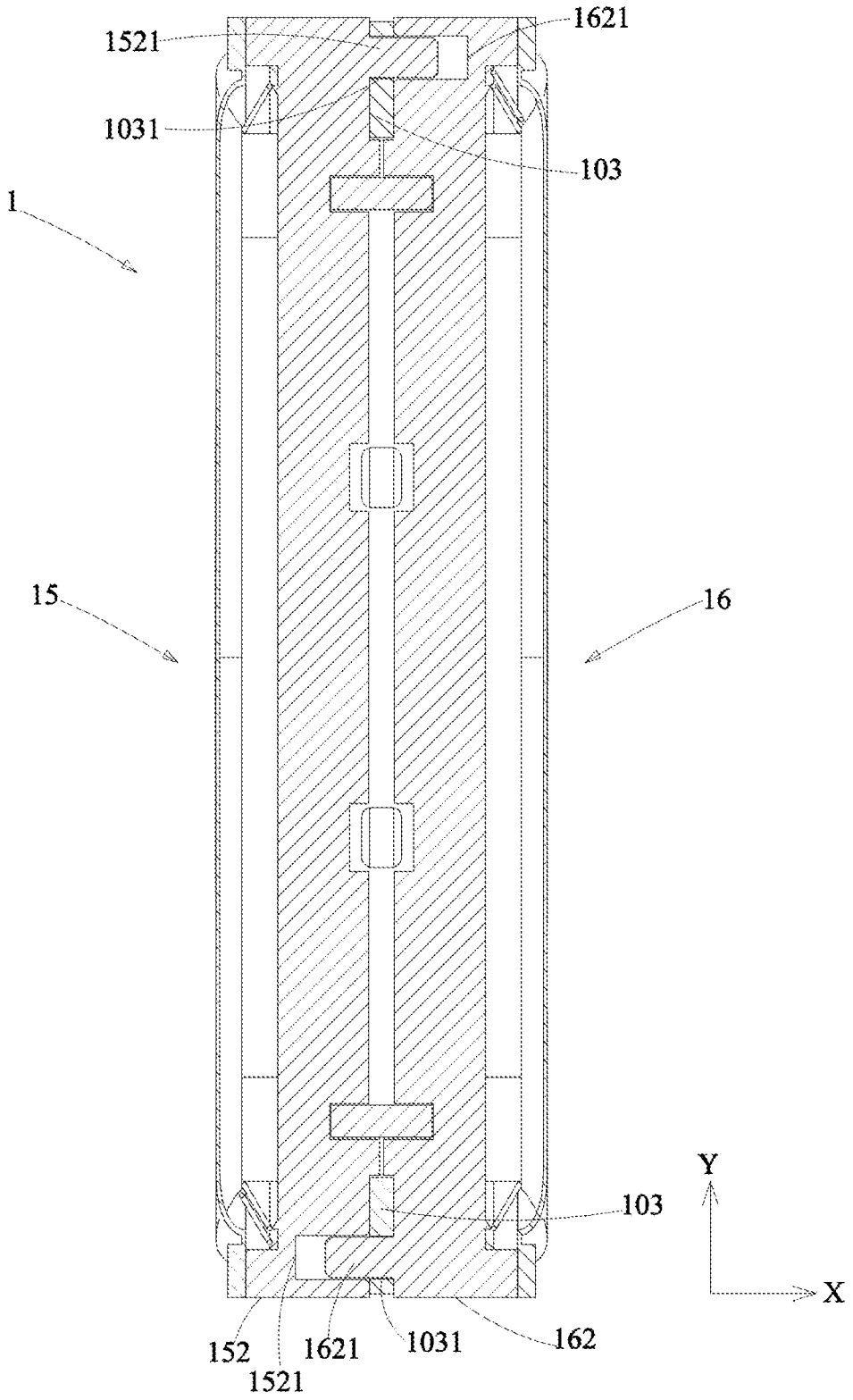
FIG. 5 is a cross-sectional view along line B-B' of FIG. 1.

FIG. 5 is a cross-sectional view along line B-B' of FIG. 1. Referring to FIG. 2, FIG. 3, and FIG. 5, in this embodiment, the magnetic conductive carrier board 10 comprises a magnetic conductive board body 102 and a plurality of positioning cantilevers 103. One ends of the plurality of positioning cantilevers 103 are respectively connected with the magnetic conductive board body 102, and the plurality of positioning cantilevers 103 are disposed around the magnetic conductive board body 102 at intervals. The other ends of the plurality of positioning cantilevers 103 are respectively connected with the first sounding hood 15 and the second sounding hood 16. The plurality of openings 101 are respectively disposed between two adjacent positioning cantilevers 103. In this embodiment, the number of positioning cantilevers 103 is four. One ends of the four positioning cantilevers 103 are respectively disposed at the four corners of the magnetic conductive board body 102. The other ends of the four positioning cantilevers 103 extend in a direction toward the first sound hood 15 and the second sound hood 16 from the four corners of the magnetic conductive board body 102. A space between two adjacent positioning cantilevers 103 is the opening 101 of the magnetic conductive carrier board 10. In other words, the opening 101 is disposed between two adjacent positioning cantilevers 103.

The other ends of the plurality of positioning cantilevers 103 respectively comprise a positioning part 1031. The first bracket 152 is provided with a plurality of first positioning parts 1521 corresponding to the positioning parts 1031 of the plurality of positioning cantilevers 103. The second bracket 162 is provided with a plurality of second positioning parts 1621 corresponding to the positioning parts 1031 of the plurality of positioning cantilevers 103. The positioning parts 1031 of the plurality of positioning cantilevers 103 are respectively connected with the plurality of first positioning parts 1521 and the plurality of second positioning parts 1621. The first sounding hood 15, the magnetic conductive carrier board 10, and the second sounding hood 16 are integrally connected through laser soldering. In this embodiment, the positioning part 1031 is a through hole, the plurality of first positioning parts 1521 are respectively a positioning groove or a positioning column, and the plurality of second positioning parts 1621 are respectively a positioning column or a positioning groove. The positioning columns respectively pass through the through holes and are disposed in the positioning grooves.

Figure 6:
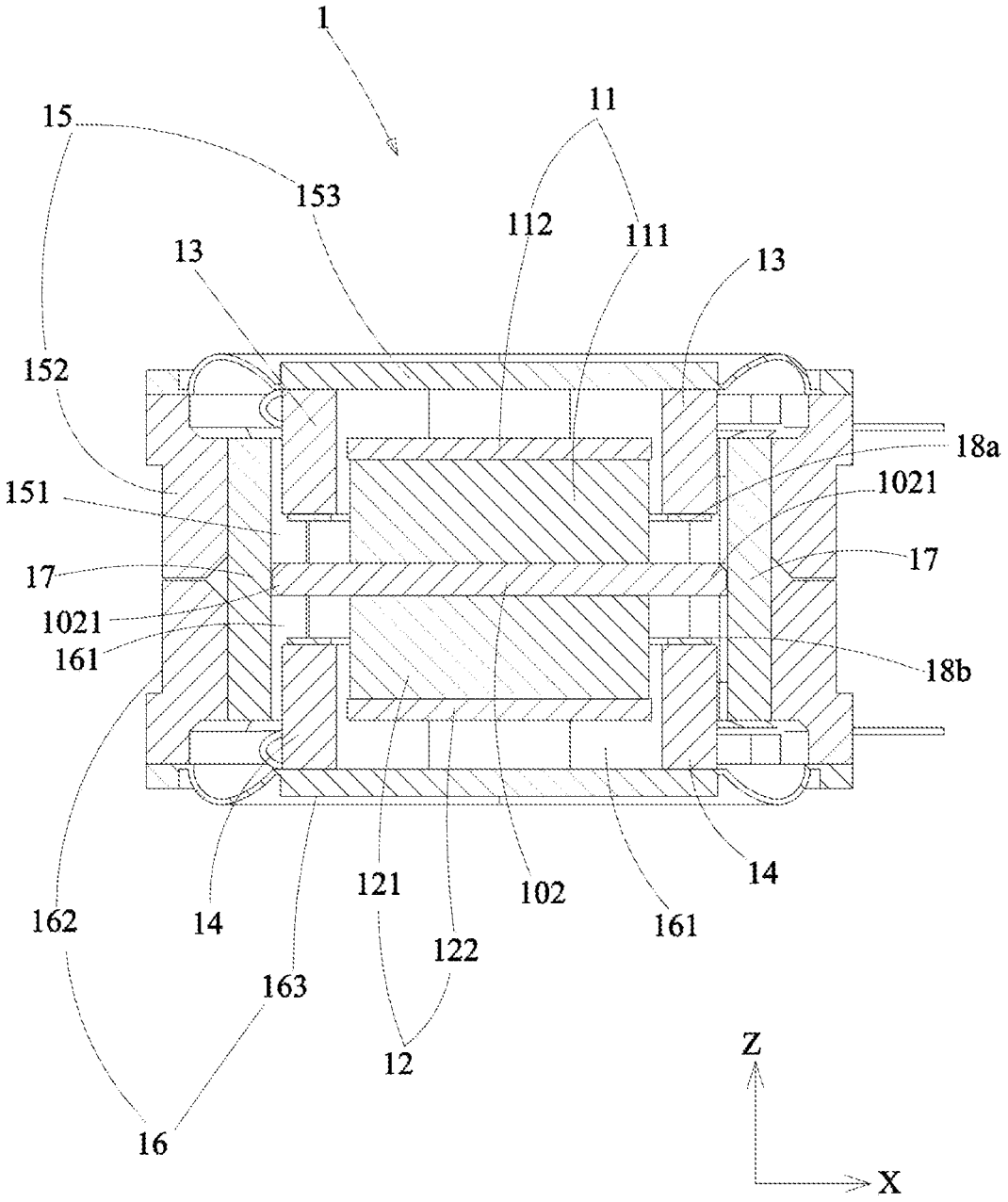
FIG. 6 is a cross-sectional view along line C-C' of FIG. 1.

FIG. 6 is a cross-sectional view along line C-C' of FIG. 1. As shown in the figure, in this embodiment, the double sided speaker device 1 further comprises two side magnetic conductive boards 17 respectively connected with two opposite sides of the magnetic conductive carrier board 10. In this embodiment, the two side magnetic conductive boards 17 are respectively disposed on two opposite sides of the magnetic conductive carrier board 10 in the first direction X, that is, the two side magnetic conductive boards 17 are respectively disposed on the left side and the right side of the magnetic conductive carrier board 10. In this embodiment, the two side magnetic conductive boards 17 are respectively disposed at two openings 101 on the left side and right side of the magnetic conductive board body 102. The two side magnetic conductive boards 17 are respectively disposed in the corresponding opening 101 and extend toward the first accommodating space 151 and the second accommodating space 161. Two ends of the two side magnetic conductive boards 17 are respectively connected with two adjacent positioning cantilevers 103. The first voice coil 13 is disposed between the two side magnetic conductive boards 17 and the first magnetic circuit module 11, and the second voice coil 14 is disposed between the two side magnetic conductive boards 17 and the second magnetic circuit module 12. In this embodiment, the magnetic poles of the two side magnetic conductive boards 17 are the same as that of the magnetic conductive carrier board 10.

As shown in FIG. 3, FIG. 5, FIG. 6, in this embodiment, two ends of the two side magnetic conductive boards 17 are respectively connected with the positioning parts 1031 of two adjacent positioning cantilevers 103. The two side magnetic conductive boards 17 respectively comprise a magnetic conductive part 171 and two abutting bumps 172. The two abutting bumps 172 are respectively disposed at two ends of the magnetic conductive part 171. In this embodiment, the magnetic conductive part 171 protrudes toward the first voice coil 13 or the second voice coil 14 relative to the two abutting bumps 172. The other ends of the plurality of positioning cantilevers 103 further comprise an abutting notch 1032, respectively. The two abutting bumps 172 of the two side magnetic conductive boards 17 are respectively disposed in the abutting notches 1032 of the two adjacent positioning cantilevers 103. By respectively providing two abutting bumps 172 in the corresponding abutting notches 1032, the side magnetic conductive board 17 is restricted to not to move toward the magnetic conductive board body 102. In this way, the side magnetic conductive board 17 can be positioned in the corresponding opening 101. In this embodiment, two opposite sides of the magnetic conductive board body 102 further comprise an abutting bump 1021, respectively. The abutting bump 1021 abuts against the corresponding side magnetic conductive board 17. In this embodiment, the left side and right side of the magnetic conductive board body 102 respectively comprise an abutting bump 1021. The abutting bump 1021 can restrict the movement of the side magnetic conductive board 17 toward the magnetic conductive board body 102, and can also support the magnetic conductive part 171 of the side magnetic conductive board 17 to stabilize the side magnetic conductive board 17 in the corresponding opening 101.

One side of the first bracket 152 away from the first diaphragm 153 further comprises a plurality of first limiting notches 1522. One side of the second bracket 162 away from the second diaphragm 163 further comprises a plurality of second limiting notches 1622 corresponding to the plurality of first limiting notches 1522. The two abutting bumps 172 of the two side magnetic conductive boards 17 are respectively disposed at the corresponding first limiting notch 1522 and the second limiting notch 1622. A sidewall of the first limiting notch 1522 and a sidewall of the second limiting notch 1622 in the third direction Z restrict the abutting bump 172 from moving in the third direction Z, thereby preventing the two side magnetic conductive boards 17 from moving in the third direction Z. Meanwhile, the sidewall of the first limiting notch 1522, the sidewall of the second limiting notch 1622, and a sidewall of the abutting notch 1032 in the second direction Y restrict the abutting bump 172 from moving in the second direction Y, thereby preventing the two side magnetic conductive boards 17 from moving in the second direction Y. In this way, the two side magnetic conductive boards 17 can be fixed in the corresponding openings 101 respectively.

In this embodiment, the double sided speaker device 1 further comprises a first damper 18*a* and a second damper 18*b*. Two ends of the first damper 18*a* are connected with the first bracket 152 of the first sounding hood 15. The first damper 18*a* is disposed between the first magnetic circuit module 11 and the two side magnetic conductive boards 17 and is in contact with the first voice coil 13. Similarly, two ends of the second damper 18*b* are connected with the second bracket 162 of the second sounding hood 16. The second damper 18*b* is disposed between the second magnetic circuit module 12 and the two side magnetic conductive boards 17 and is in contact with the second voice coil 14. In this embodiment, since the first damper 18*a* limits the displacement of the first voice coil 13 in the first direction X and the second damper 18*b* limits the displacement of the second voice coil 14 in the second direction X, the distance between the first voice coil 13 and the first magnetic circuit module 11, the distance between the first voice coil 13 the side magnetic conductive board 17, the distance between the second voice coil 14 and the second magnetic circuit module 12, and the distance between the second voice coil 14 and the side magnetic conductive board 17 can be ensured. It can also be ensured that the first voice coil 13 and the second voice coil 14 could be vibrating in the third direction Z.

As shown in FIG. 3, in this embodiment, the first damper 18*a* and the second damper 18*b* respectively comprise a limiting part 181, two connecting parts 182, and two elastic cushioning parts 183. The two connecting parts 182 are respectively disposed at two opposite ends of the limiting part 181. The two elastic cushioning parts 183 are respectively connected with the corresponding connecting part 182 and the limiting part 181. In this embodiment, the two elastic cushioning parts 183 respectively comprise a bent elastic piece 1831, which comprises a plurality of bent sections 1831*a*. It should be further explained that the first damper 18*a* and the second damper 18*b* are sheet-shaped, of which the center parts are hollowed. Thus, the first damper 18*a* and the second damper 18*b* could respectively connect with the first magnetic circuit module 11 and the second magnetic circuit module 12 to allow the first magnetic circuit module 11 and the second magnetic circuit module 12 within the double sided speaker device 1 to reciprocate steadily in the third direction Z when the double sided speaker device 1 is in operation.

In summary, embodiments of the present disclosure provide a double sided speaker device. The magnetic conductive carrier board, the first voice coil, the first magnetic circuit module, and the first sounding hood form a first speaker part, and the magnetic conductive carrier board, the second voice coil, the second magnetic circuit module, and the second sounding hood form a second speaker part. The first voice coil works on the first magnetic circuit module and the second voice coil works on the second magnetic circuit module for realizing double side speaking. Meanwhile, since the mass vibration of the first voice coil and that of the second voice coil are exactly same to be canceled, the vibration of the double sided speaker device 1 can be reduced and the vibration area of the first diaphragm and the second diaphragm can be increased to enhance the performance of the double sided speaker device. Besides, the first accommodating space and the second accommodating space play as the two resonant cavities for the double sided speaker device. The two resonant cavities are mutually connected through a plurality of openings. Thus, the capacity of the resonant cavity of the double sided speaker device can be increased, and the tone quality of the double sided speaker device can be effectively improved without increasing the size of the double sided speaker device.

It is to be understood that the term "comprises", "comprising", or any other variants thereof, is intended to encompass a non-exclusive inclusion, such that a process, method, article, or device of a series of elements not only comprise those elements but further comprises other elements that are not explicitly listed, or elements that are inherent to such a process, method, article, or device. An element defined by the phrase "comprising a . . . " does not exclude the presence of the same element in the process, method, article, or device that comprises the element.

Although the present disclosure has been explained in relation to its preferred embodiment, it does not intend to limit the present disclosure. It will be apparent to those skilled in the art having regard to this present disclosure that other modifications of the exemplary embodiments beyond those embodiments specifically described here may be made without departing from the spirit of the disclosure. Accordingly, such modifications are considered within the scope of the disclosure as limited solely by the appended claims.

What is claimed is:

1. A double sided speaker device, comprising:

a magnetic conductive carrier board comprising a plurality of openings;

a first magnetic circuit module disposed at one side of the magnetic conductive carrier board;

a second magnetic circuit module disposed at the other side of the magnetic conductive carrier board, the second magnetic circuit module being opposite to the first magnetic circuit module, the plurality of openings being disposed between the first magnetic circuit module and the second magnetic circuit module;

a first voice coil disposed around the first magnetic circuit module;

a second voice coil disposed around the second magnetic circuit module, the second voice coil corresponding to the first voice coil;

a first sounding hood disposed at the one side of the magnetic conductive carrier board and comprising a first accommodating space, the first magnetic circuit module and the first voice coil being disposed in the first accommodating space;

a second sounding hood disposed at the other side of the magnetic conductive carrier board and comprising a second accommodating space; the second magnetic circuit module and the second voice coil being disposed in the second accommodating space; the second accommodating space being communicating with the first accommodating space through the plurality of openings; and two side magnetic conductive boards, the two side magnetic conductive boards being respectively connected with two opposite sides of the magnetic conductive carrier board, the two side magnetic conductive boards being respectively disposed in the corresponding opening and extending toward the first accommodating space and the second accommodating space, the first voice coil being disposed between the two side magnetic conductive boards and the first magnetic circuit module, the second voice coil being disposed between the two side magnetic conductive boards and the second magnetic circuit module;

wherein the first magnetic circuit module comprises a first magnetic body and a first magnetic conductive board; the first magnetic body is disposed at the one side of the magnetic conductive carrier board; the first magnetic conductive board is disposed at one side of the first magnetic body away from the magnetic conductive carrier board; the second magnetic circuit module comprises a second magnetic body and a second magnetic conductive board; the second magnetic body is disposed at the other side of the magnetic conductive carrier board; the second magnetic conductive board is disposed at one side of the second magnetic body away from the magnetic conductive carrier board;

wherein the magnetic conductive carrier board comprises a magnetic conductive board body and a plurality of positioning cantilevers; one ends of the plurality of positioning cantilevers are respectively connected with the magnetic conductive board body; the plurality of positioning cantilevers are disposed on the periphery of the magnetic conductive board body at intervals; the other ends of the plurality of positioning cantilevers are respectively connected with the first sounding hood and the second sounding hood; the plurality of openings are respectively disposed between two adjacent positioning cantilevers.

2. The double sided speaker device according to claim 1, wherein two opposite sides of the magnetic conductive board body further comprise an abutting bump; the abutting bump abuts against the corresponding side magnetic conductive board.

3. The double sided speaker device according to claim 1, wherein the first sound hood comprises a first bracket and a first diaphragm; the first bracket is disposed at the one side of the magnetic conductive carrier board; the first diaphragm is disposed at one side of the first bracket away from the magnetic conductive carrier board and is connected with the first voice coil; the second sound hood comprises a second bracket and a second diaphragm; the second bracket is disposed at the other side of the magnetic conductive carrier board; the second diaphragm is disposed at one side of the second bracket away from the magnetic conductive carrier board and is connected with the second voice coil.

4. The double sided speaker device according to claim 3, wherein the other ends of the plurality of positioning cantilevers respectively comprise a positioning part; the first bracket is provided with a plurality of first positioning parts corresponding to the positioning parts of the plurality of positioning cantilevers; the second bracket is provided with a plurality of second positioning parts corresponding to the positioning parts of the plurality of positioning cantilevers; the positioning parts of the plurality of positioning cantilevers are respectively connected with the plurality of first positioning parts and the plurality of second positioning parts.

5. The double sided speaker device according to claim 4, wherein two ends of the two side magnetic conductive boards are respectively connected with the positioning parts of the two adjacent positioning cantilevers.

6. The double sided speaker device according to claim 4, wherein the positioning part is a through hole; the plurality of first positioning parts are respectively a positioning groove or a positioning column; the plurality of second positioning parts are respectively a positioning column or a positioning groove; the positioning columns respectively pass through the through holes and are disposed in the positioning grooves.

7. The double sided speaker device according to claim 4, wherein the two side magnetic conductive boards respectively comprise a magnetic conductive part and two abutting bumps; the two abutting bumps are respectively disposed at two ends of the magnetic conductive part; the other ends of the plurality of positioning cantilevers further comprise an abutting notch; the two abutting bumps of the two side magnetic conductive boards are respectively disposed in the abutting notches of the two adjacent positioning cantilevers.

8. The double sided speaker device according to claim 7, wherein one side of the first bracket away from the first diaphragm further comprises a plurality of first limiting notches; one side of the second bracket away from the second diaphragm further comprises a plurality of second limiting notches corresponding to the plurality of first limiting notches; the two abutting bumps of the two side magnetic conductive boards are respectively disposed in the corresponding first limiting notch and the corresponding second limiting notch.

9. The double sided speaker device according to claim 4 comprising a first damper and a second damper, two ends of the first damper being connected with the first bracket of the first sounding hood, the first damper being disposed between the first magnetic circuit module and the two side magnetic conductive boards and being in contact with the first voice coil, two ends of the second damper being connected with the second bracket of the second sounding hood, the second damper being disposed between the second magnetic circuit module and the two side magnetic conductive boards and being in contact with the second voice coil.

10. The double sided speaker device according to claim 9, wherein the first damper and the second damper respectively comprise a limiting part, two connecting parts, and two elastic cushioning parts; the two connecting parts are respectively disposed at two opposite ends of the limiting part; the two elastic cushioning parts are respectively connected with the corresponding connecting part and the corresponding limiting part.

11. The double sided speaker device according to claim 10, wherein the two elastic cushioning parts respectively comprise a bent elastic piece; the bent elastic piece comprises a plurality of bent sections.

12. The double sided speaker device according to claim 3, wherein a surface of the first bracket connecting with the first diaphragm comprises a first wiring groove; the first wiring groove is in communication with the first accommodating space; a surface of the second bracket connecting with the second diaphragm comprises a second wiring groove; the second wiring groove is in communication with the second accommodating space.

* * * * *